US006786735B2

(12) United States Patent
Gothier

(10) Patent No.: US 6,786,735 B2
(45) Date of Patent: Sep. 7, 2004

(54) WIRELESS ELECTRICAL CONNECTION FOR COMPONENTS MOUNTED ON A MOVABLE TRUCK BED

(75) Inventor: Richard Gothier, Gilbert, AZ (US)

(73) Assignee: Aero Industries, Inc., Indianapolis, IN (US)

( * ) Notice: Subject to any disclaimer, the term of this patent is extended or adjusted under 35 U.S.C. 154(b) by 0 days.

(21) Appl. No.: 10/209,139

(22) Filed: Jul. 31, 2002

(65) Prior Publication Data

US 2004/0023521 A1 Feb. 5, 2004

(51) Int. Cl.[7] ..... H01R 33/00
(52) U.S. Cl. ..... 439/34; 439/289; 280/422
(58) Field of Search ..... 439/34, 700, 824, 439/289, 197; 280/422

(56) References Cited

U.S. PATENT DOCUMENTS 2,634,349 A * 4/1953 Genter ..... 439/824
2,916,723 A * 12/1959 Cronin ..... 439/824
4,111,452 A * 9/1978 Carlsson ..... 280/421

* cited by examiner

*Primary Examiner*—Javaid H. Nasri
(74) *Attorney, Agent, or Firm*—Maginot, Moore & Beck

(57) ABSTRACT

An electrical connection assembly provides an electrical connection for an electrical component mounted on a movable bed of a vehicle. The electrical connection assembly includes a sub-assembly supported on the movable bed, and another sub-assembly supported on the frame of the vehicle so that the two sub-assemblies make electrical contact when the bed is in one position. The electrical contact can be broken when the bed moves relative to the vehicle frame. In one embodiment, both sub-assemblies are biased toward each other to maintain a solid electrically conductive path between conductive contacts on each sub-assembly. One sub-assembly can include a number of conductive plates, while the other can include a-like number of conductive plungers. The conductive components are supported on insulator plates. One of the plates defines a plunger bore to receive a plunger therein such that the plunger can reciprocate and pivot angularly relative to the plate. A spring can be disposed within the bore to bias the plunger outwardly from the bore. The plunger can include an enlarged head having a chamfer to accommodate angular orientations of the plunger relative to the insulator plate.

22 Claims, 5 Drawing Sheets

WIRELESS ELECTRICAL CONNECTION FOR COMPONENTS MOUNTED ON A MOVABLE TRUCK BED

BACKGROUND OF THE INVENTION

The present invention relates to electrical connection systems for use on vehicles having a pivoting or movable bed. In particular, the invention relates to electrical connect/disconnect system for providing electrical power to electrical components mounted on the movable truck bed.

In a typical hauling vehicle, the hauling bed is movably mounted on the frame of the transport vehicle. For instance, in a dump truck, the dump body is pivotably mounted to the frame of the dump truck. Thus, the dump body can pivot about the rear end of the vehicle to relinquish its load. In other types of hauling vehicles, the hauling body or container is conveyed linearly off the frame, such as by a roller system.

Optimally, a hauling vehicle will include a cover system, which can be employed to cover the open top of the hauling body. An example of one type of widely used cover system is shown in FIG. 1. As shown in this figure, a truck 10 includes a dump bed 11 pivotably mounted on the truck frame 12. A cover or tarp system 14 is mounted to the vehicle and includes a flexible cover or tarpaulin 15 that is attached to one end to a bail arm 17. The bail arm is pivotably mounted to the container bed 11. The opposite end of the tarp 15 is deployed from a tarp roller assembly 16. In a typical system, the bail arm 17 is spring biased to pivot the bail arm toward the rear end of the dump bed 11, thereby drawing the tarp 15 over the open top of the container.

In order to retract the tarp, the tarp roller assembly 16 is rotated in the opposite direction to wind the tarp onto the roller assembly. In some installations, the roller assembly is manually driven by way of a crank arrangement. However, as shown in FIG. 1, an electric motor 18 can be used to drive the roller assembly and retract the tarp 15 into its stored position within the tarp roller assembly 16. An example of a system of this type is the Easy Cover® tarping system sold by Aero Industries, Inc.

In the case where the tarp system 14 is electrically powered—i.e., includes an electric motor 18—electricity must be provided to the system. However, since the motor is supported on the dump bed 11, and most preferably on a cab extension 19 of the bed, the motor 18 moves with the dump bed 11. Nominally, when the dump bed 11 is pivoted relative to the vehicle frame 12, the cover system is in its retracted position. Moreover, there is no need to deploy the cover assembly 14 when the dump bed 11 is in its pivoted, unloading, position.

On the other hand, when the dump bed is in its hauling position, such as that shown in FIG. 1, electrical power must be provided to the motor 18 to allow retraction of the tarpaulin 15. Of course, a separate power supply system can be included with the motor 18 or associated with the dump bed 11; however, this is undesirable. As a further alternative, the wiring for connecting the motor 18 to the electrical system of the truck 10 can span the length of the dump bed, pass around the pivot point of the bed and back along the vehicle frame to connect with the vehicle electrical system. Of course, this approach means extending electrical wire along the entire length of the moving dump bed, which is not an optimal solution.

In order to address these problems, wireless disconnect systems have been developed that provide electrical connection when the dump bed is in its hauling position, such as shown in FIG. 1, but that can be disconnected when the bed is moved. One such system utilizes a flat electrical contact plate mounted to the underside of the dump bed at its forward end, and a mating set of electrical contact plates fixed to the vehicle frame in alignment for contact with the plates mounted on the dump bed. This approach frequently does not provide a reliable electrical connection either due to misalignment of the dump bed relative to the frame, or due to wear and corrosion of the contact plates. Consequently, there remains a need for an electrical connect/disconnect system that can reliably provide electrical connection for supplying power to electrical components mounted on a movable dump bed.

SUMMARY OF INVENTION

In order to address these problems, the present invention contemplates an electrical connection assembly for an electrical component mounted on a bed movably mounted on a frame of a vehicle having a power source. The assembly can comprise a first sub-assembly mountable to the frame and including a first number of electrical contacts electrically connectable to the vehicle power source. Each of the number of electrical contacts can be biased toward the bed of the vehicle when the first sub-assembly is mounted on the frame.

The electrical connection assembly can further comprise a second sub-assembly including a second number of electrical contacts electrically connectable to the electrical component. The second sub-assembly is mountable on the bed of the vehicle so that the second number of electrical contacts move into and out of electrical engagement with the first number of electrical contacts as the bed moves relative to the frame. Each of the second number of electrical contacts can be biased toward the frame of the vehicle, or more particularly toward the first number of electrical contacts, when the second sub-assembly is mounted on the bed.

In one embodiment of the invention, the first sub-assembly can include a first insulator plate mountable to the vehicle frame. The first number of electrical contacts can include at least one electrically conductive plate supported on the first insulator plate. In a specific embodiment, two such plates are supported on the insulator plate. This sub-assembly can include first means for biasing the first insulator plate away from the vehicle frame, in which the first means for biasing is disposed between the first insulator plate and the frame when the first insulator plate is mounted thereto. In one embodiment, this first means for biasing includes a coil spring, which can be concentrically disposed about bolts used to support the plate.

The second sub-assembly can includes a second insulator plate mountable to the bed of the vehicle. The second number of electrical contacts can include a plunger electrically connectable to the electrical component, in which the plunger is movably supported by the second insulator plate. A second means for biasing can be provided for biasing the plunger away from the plate. In one embodiment of the invention, the second insulator plate defines a bore corresponding to the plunger, the plunger being slidably mounted within the bore. Further, the second means for biasing can include a spring disposed within the bore between the plunger and the second insulator plate.

In one feature, the plunger includes an elongated body and an enlarged head disposed within the bore. The second sub-assembly can include a retainer plate disposed over the bore and defining an opening sized to receive the elongated body but not the enlarged head therethrough. The enlarged head of the plunger can define a chamfer adjacent the retainer plate. In one aspect of this embodiment, the opening is sized relative to the elongated body of the plunger to permit the plunger to assume a non-perpendicular angle relative to the retainer plate with the chamfer in contact with the retainer plate. The enlarged head of the plunger can also define a second chamfer adjacent the spring.

In a further aspect of the invention, an electrical connection assembly for an electrical component mounted on a bed movably mounted on a frame of a vehicle having a power source includes a first sub-assembly mountable to the frame and including a first number of electrical contacts electrically connectable to the vehicle power source. A second sub-assembly includes a second number of electrical contacts electrically connectable to the electrical component, the second sub-assembly mountable on the bed of the vehicle so that the second number of electrical contacts move into and out of electrical engagement with the first number of electrical contacts as the bed moves relative to the frame. In one aspect of this embodiment, each of the second number of electrical contacts is biased toward the frame of the vehicle when the second sub-assembly is mounted on the bed. Further, each of the second number of contacts is supported to permit variable angular orientations of the second number of contacts relative to the bed.

The second sub-assembly can includes a second insulator plate mountable to the bed of the vehicle, in which the insulator plate defines a number of bores therein. The second number of electrical contacts can include a plunger electrically connectable to the electrical component, the plunger movably supported within a bore in the insulator plate to permit variable angular orientations of the plunger relative thereto. A means for biasing the plunger away from the plate can be disposed within the bore between the plunger and the plate.

The plunger in this embodiment includes an elongated body and an enlarged head disposed within the bore. A retainer plate is included with the second sub-assembly-that is disposed over the bore and that defines an opening sized to receive the elongated body but not the enlarged head therethrough. The enlarged head of the plunger defines a chamfer adjacent the retainer plate. The opening is sized relative to the elongated body of the plunger to permit the plunger to assume a non-perpendicular angle relative to the retainer plate with the chamfer in contact with the retainer plate.

DESCRIPTION OF THE PREFERRED EMBODIMENTS

Figure 1:
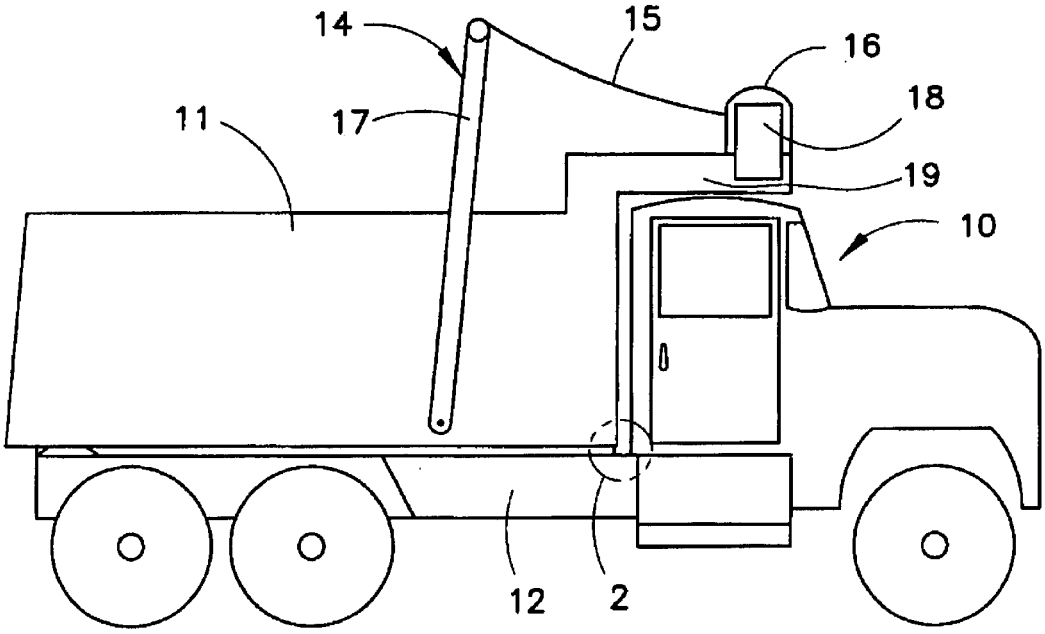
FIG. 1 (PRIOR ART)
FIG. 1 is a side representation of a hauling vehicle with an electrically powered cover system mounted thereon.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

The present invention relates to an electrical connect/disconnect assembly for use on a vehicle having a movable hauling body or container. For purposes of illustration only, the invention has been described for use with an electrically powered tarp system mounted on a dump truck, such as the truck 10 shown in FIG. 1. Again for purposes of illustration only, it has been presumed that the dump bed 11 will pivot relative to the frame 12, which pivoting motion produces the connect and disconnect functions of the present invention. The principles of the invention can be equally applied to a hauling bed that translates, rather than pivots, relative to the vehicle frame.

Figure 2:
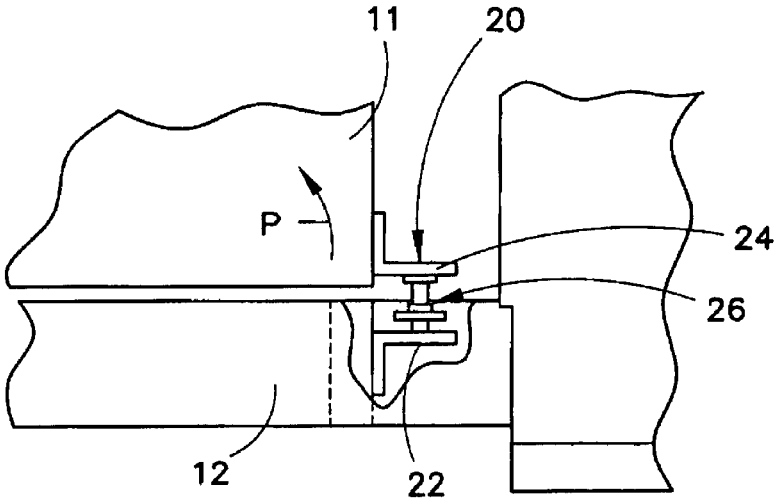
FIG. 2 is an enlarged view of the area 2 shown in FIG. 1, depicting one embodiment of the electrical disconnect assembly of the present invention.
Figure 3:
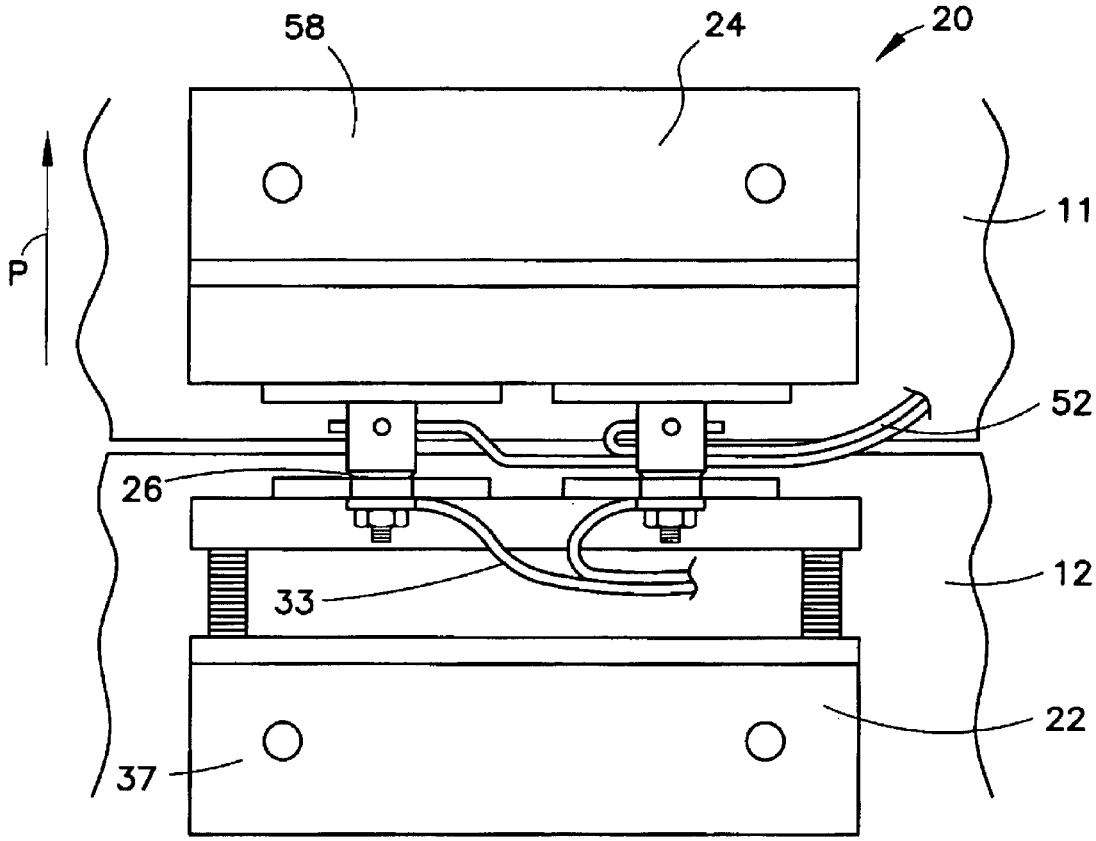
FIG. 3 is an enlarged front elevational view of the electrical disconnect assembly shown in FIG. 2.

As shown in FIGS. 2 and 3, an electrical disconnect assembly 20 according to one embodiment of the invention can be mounted between the movable dump bed 11 and the truck frame 12. The disconnect assembly 20 includes a lower contact sub-assembly 22 that is mounted to the frame 12, and an upper contact sub-assembly 24 that is mounted to the movable dump bed 11. As shown best is FIG. 3, the lower contact sub-assembly includes electrical wires 33 that are electrically connected to the vehicle power supply or the electrical system. Since the lower contact sub-assembly 22 is mounted on the vehicle frame 12, the supply wires 33 can be readily integrated into the existing electrical system of the vehicle. In addition, the upper contact sub-assembly 24 includes wires 52 that are electrically connected to a power component mounted to the movable dump bed 11. In the specific illustrated embodiments, the electrical wires 52 are connected to the motor 18 of the cover system 14. It is understood that either or both of the wires 33 and 52 can be connected through appropriate switching networks to provide an override feature for manually disconnecting the wires from the electrical power supply of the vehicle.

As reflected in FIGS. 2 and 3 the upper contact sub-assembly 24 can move away from the lower sub-assembly 22 as the dump bed 11 pivots or moves in the direction of the arrow P. Nominally, the two sub-assemblies 22 and 24 engage at a contact point 26 which completes the electrical power supply to the particular electrical component mounted on the dump bed 11.

Figure 4:
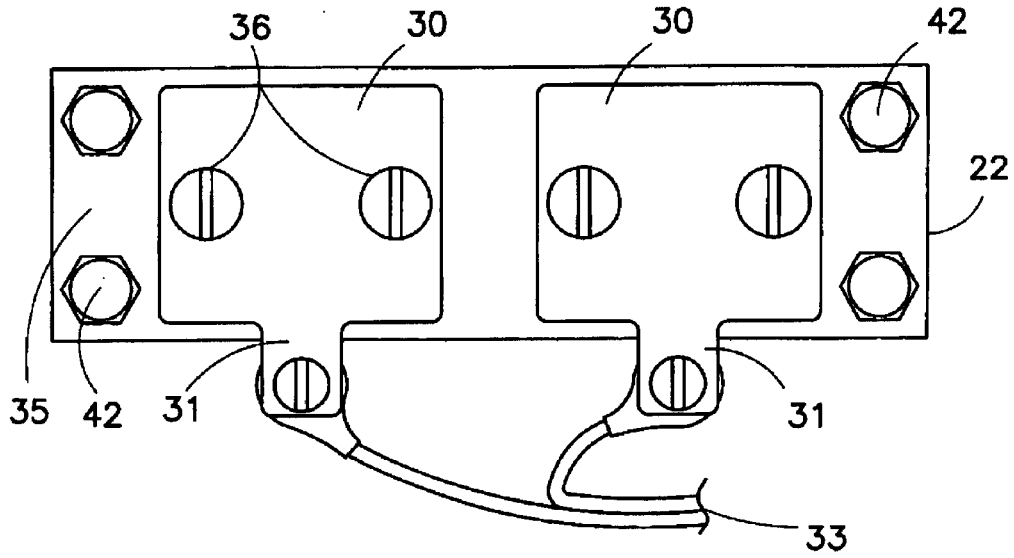
FIG. 4 is a top elevational view of a lower contact sub-assembly of the electrical disconnect assembly shown in FIGS. 2 and 3.
Figure 5:
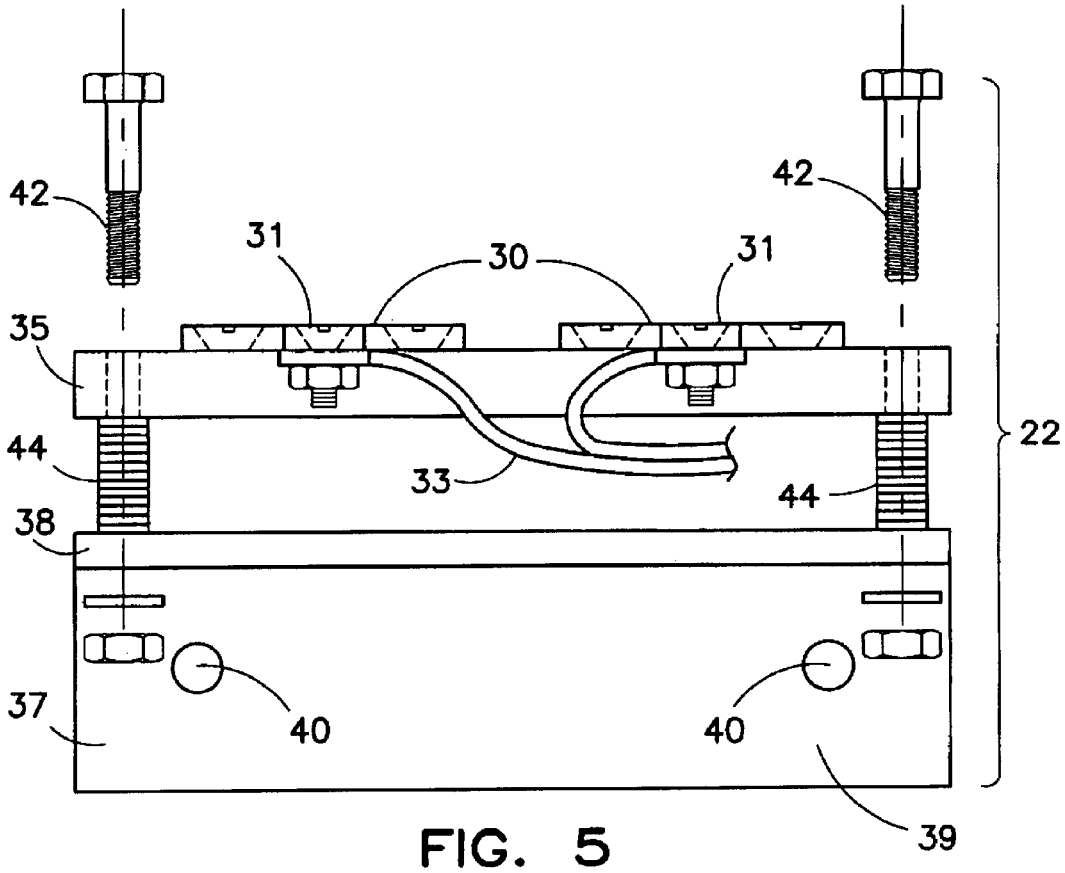
FIG. 5 is a front elevational view of the lower contact sub-assembly shown in FIG. 4.

In the preferred embodiment, the lower contact sub-assembly 22 includes a pair of striker plates 30. Each of the plates 30 includes an outwardly extending connection tab 31 that is connected to an electrical supply wire 33. As shown in FIGS. 4 and 5, the supply wire 33 can be connected to the tab 31 by a flat conductor and a screw-bolt arrangement. Of course, other means for connecting the supply wire to the connection tab 31 are contemplated, such as by electrical clamps, or even welding or soldering.

The striker plates 30 are formed of an electrically conducting material, most preferably a material that is corrosion resistant. In a specific embodiment, the striker plate 30 can be formed of brass. Since the striker plates 30 are electrically conductive, they are preferably mounted on an insulator plate 35. The insulator plate 35 can be formed of a non-conductive material such as plastic or nylon, or a non-conductive metal. The striker plates 30 can be mounted to the insulator plate 35 by way of a number of mounting screws 36. Preferably, the mounting screws are themselves formed of a non-conductive metal. It is important that the mounting screws 36 not be threaded entirely through the thickness of the plate 35 so that the ends of the screws are exposed, in order to preserve the insulation effects of the plate 35.

The striker plate 30 and insulator plate 35 can be attached to the truck frame 12 by way of a mounting flange 37. Preferably, the flange 37 is an L-shaped flange with a mounting plate 38 projecting outward from the mating plate 39. The mating plate 39 includes a number of mounting holes 40 that are used to mount the flange 37 to the vehicle frame, such as by a conventional nut and bold assembly.

The insulator plate 35 is connected to the mounting flange 37 by way of the number of bolt assemblies 42. As shown best in FIG. 5, the bolt assemblies extend through a biasing spring 44 that is oriented to bias the insulating plate 35 away from the mounting flange 37. In the illustrated preferred embodiment, four such bolt assemblies 42 and bias springs 44 are provided at the four corners of the insulator plate 35. The springs 44 exert an outward force on the insulator plate 35 and resist depression of the insulator plate toward the mounting flange 37. It is understood that in operation, the upper contact sub-assembly 24 engages the lower contact sub-assembly 22 at the striker plates 30. As the upper sub-assembly moves downward against the lower sub-assembly, the insulator plate 35 is pushed toward the mounting flange 37 against the force of the bias springs 44. The springs help maintain the stability of the mounting flange 37, and provide a constant upward force through the striker plate 30 against the upper contact sub-assembly 24.

Figure 6:
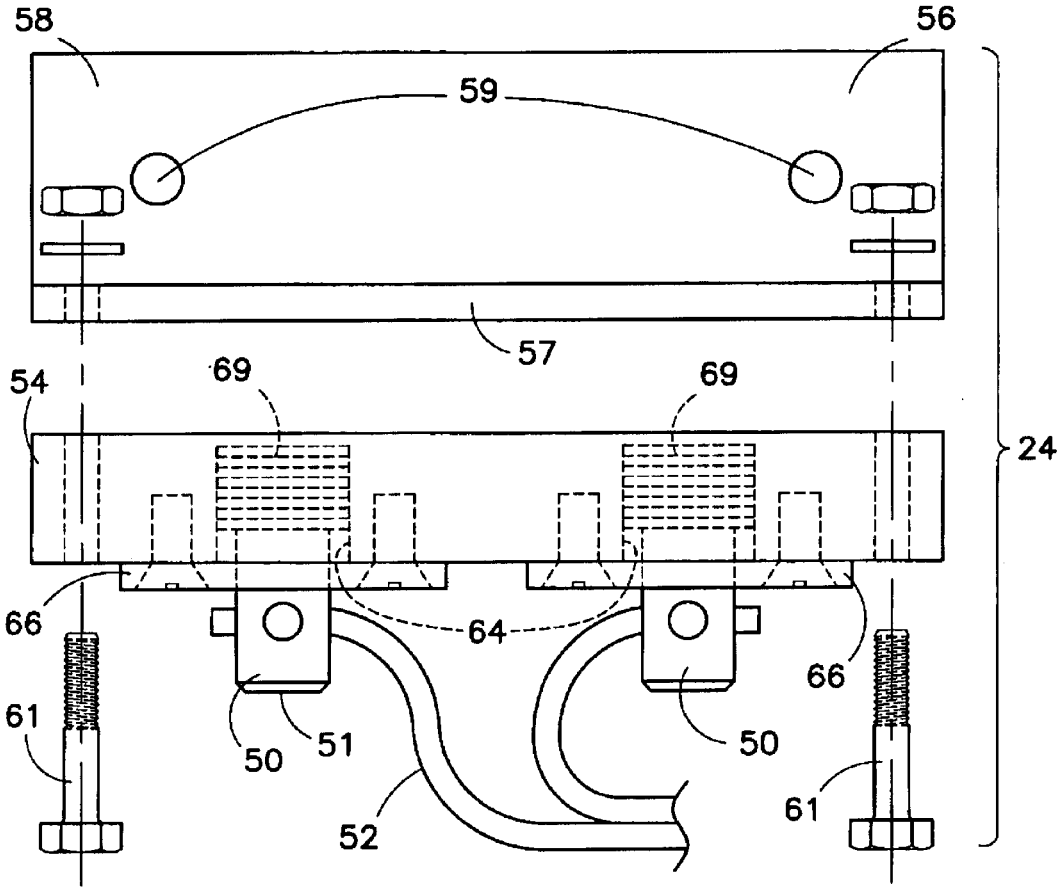
FIG. 6 is a front exploded view of an upper contact sub-assembly of the electrical disconnect assembly shown in FIG. 3.
Figure 7:
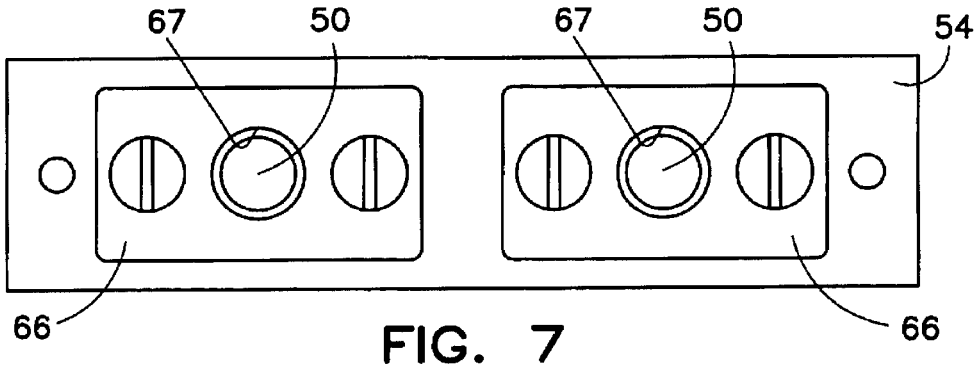
FIG. 7 is a bottom elevational view of the upper contact subassembly shown in FIG. 6.
Figure 8:
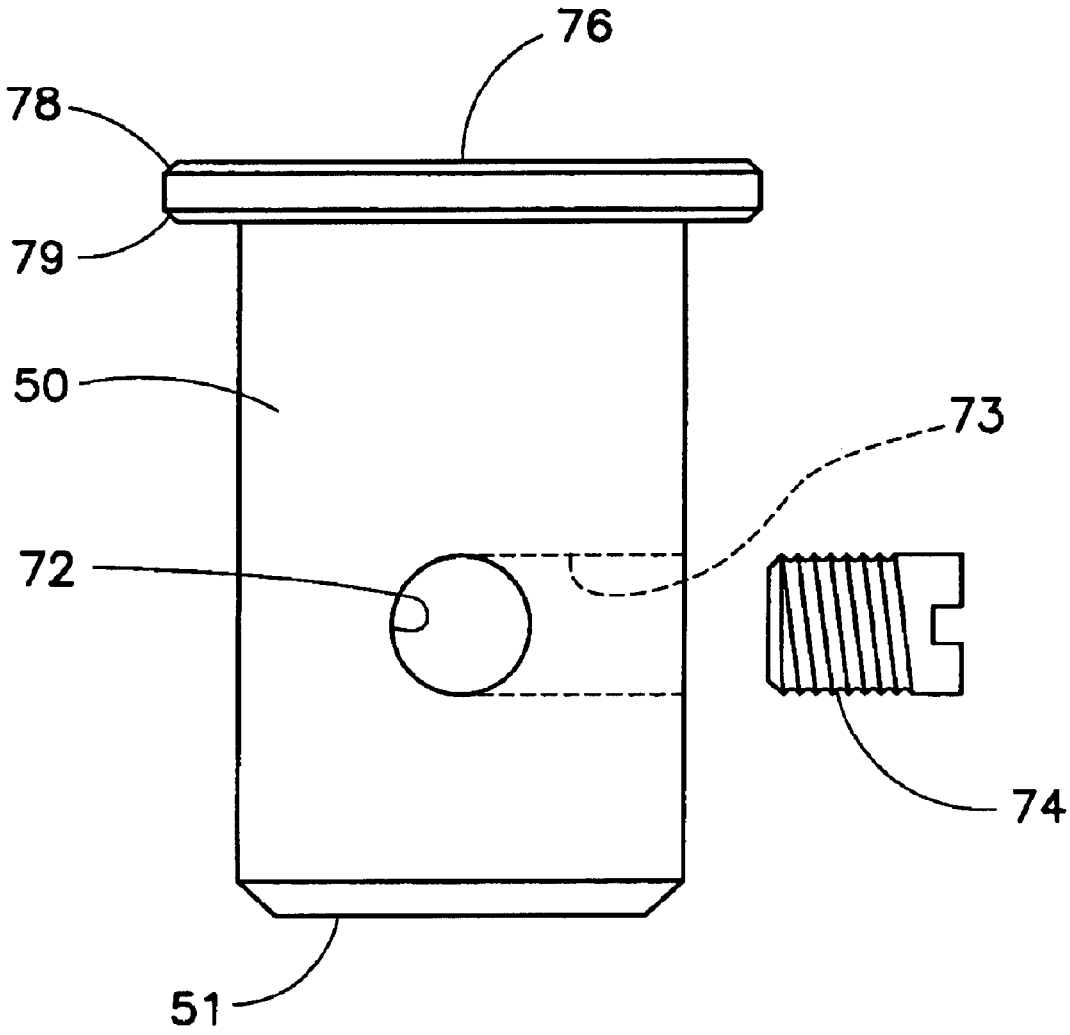
FIG. 8 is an enlarged side elevational view of an electrical connector plunger component of the upper sub-assembly shown in FIGS. 6 and 7.

Referring now to FIGS. 6–8, the components of the upper contact sub-assembly 24 are described. While the pair of striker plates 30 forms part of the electrical point 26 between the upper and lower sub-assemblies, a corresponding pair of electrical connector plunger 50 in the upper sub-assembly 24 provides the other half of the contact. The plungers 50 are preferably aligned so that they are centered over the strike plates 30. As shown in FIGS. 6 and 8, the plungers 50 include a generally flat contact surface 51 that provides a flat electrically conductive engagement with the flat striker plate 30. The plungers 50 are connected to the wires 52 that provide electrical power to the motor 18 of the tarp system 14.

As with the lower contact sub-assembly, the plungers 50 are supported on an insulator plate 54. Of course, the plungers are formed of an electrically conductive material such as the brass described above in connection with the striker plate. Likewise, the insulator plate 54 is formed of a non-conductive material, such as plastic, nylon or a non-conductive metal.

The insulator plate 54 is supported on the movable hauling bed 11 by way of a mounting flange 56. As with the lower flange, the upper mounting flange 56 is preferably L-shaped with a mounting plate 57 extending from a mating plate 58. The mating plate defines a number of mounting holes 59 that can receive bolts or other fasteners for engaging the mounting flange 56 to the body of the hauling bed 11. The insulator plate 54 is connected to the mounting flange 56 by way of a number of bolt assemblies 61.

With respect to the mounting flanges 37 and 58 that are used to mount the respective lower and upper sub-assemblies 22, 24, it can be appreciated that the configuration of the flanges is dictated by the vehicle component to which they are mounted. In other words, while the flanges are L-shaped in the illustrated embodiments, other forms of mounting flanges are contemplated for supporting the sub-assemblies on the vehicle frame 12 and container bed 11. In addition, both flanges are described as being bolted to the vehicle component. Of course, other means for fastening the flanges are contemplated, such as by rivets or welding.

Returning to FIGS. 6 and 7, the electrical connector plungers 50 are each mounted within a plunger bore 64 defined in the insulator plate 54. The bores 64 are blind, meaning that they do not extend through the entire thickness of the plate. The plungers 50 are held within the bore 64 by way of a corresponding retainer plate 66. The retainer plates 66 define a plunger opening 67 through which the body of the plunger projects. The plunger bore 64 also houses a plunger spring 69 that bears against the base of the plunger to bias the plunger outward from the bore and through the plunger opening 67 in the retainer plate 66.

As shown in the detailed view of FIG. 8, the plunger 50 includes a wire bore 72 extending diametrically through the plunger. The wire bore 72 is sized to receive an electrical conductor, such as the motor wires 52 shown in FIG. 6. In order to hold the motor wires within the bore, an intersecting bore 73 is provided that intersects the wire bore 72. A set screw 74 can be threaded into the bore 73 to bear against and trap the wire within the wire bore 72.

Also shown in FIG. 8, the plunger 50 includes an enlarged base 76 that preferably has a diameter larger than the diameter of the plunger opening 67, but smaller than the diameter of the plunger bore 64. The base 76 provides a reaction surface for the plunger spring 69, as well as a surface for retaining the plunger within the bore beneath the retainer plate 66.

In a further feature of the invention, the plunger base 76 defines an upper chamfer 78 and a lower chamfer 79. More specifically, the upper chamfer 78 faces the spring 69 while the lower chamfer 79 faces the retainer plate 66. The chamfers form one feature of the invention that allows the plunger 50 to exhibit a certain degree of "play" or angular variation within the upper contact sub-assembly 24. In addition to the chamfers, the diameter of the plunger 50 relative to the plunger opening 67, and the plunger base 76 relative to the plunger bore 64 combine to achieve this degree of "play". The clearance between the plunger and the stationary components allows the plunger to be oriented at a non-perpendicular angle relative to the upper contact sub-assembly 24.

This feature provides the significant benefit of helping achieve a firm a complete electrical contact between the contact surfaces 51 of the plungers 50 and the surface of the striker plates 30. One problem with prior fixed contacts is that as the contacts themselves wear and the mechanical components of the vehicle shift, the contact point, such as the contact point 26 shown in FIGS. 2 and 3, becomes compromised. For instance, in some cases the contact points are reduced to simply the edge of one contact engaging the surface of the other. Under these circumstances, the electrical conduction across the contact point is minimized so that current flowing across the contact may be insufficient to power the electrical components on the movable bed. However, with the present invention, the degree of play that the plungers are capable of allow them to achieve a flush surface-to-surface contact between the contact surfaces 51 and the striker plates 30.

In addition, the plunger spring 69 allows a further degree of play while also providing an outward force to push the plunger directly into contact with the striker plate 30. It can be seen that the biasing springs 44 of the lower sub-assembly 22 and the plunger spring 69 of the upper sub-assembly 24 combine to provide a solid pressure between the striker plates 30 and plungers 50. In the illustrated embodiments, the respective springs are standard coil springs; however, it is understood that other types of springs or components exhibiting spring-like properties can be incorporated into the sub-assemblies of the present invention. The components must be capable of biasing the corresponding plate 35 or plungers 50 toward each other when the respective sub-assemblies are mounted to the frame and container bed. For instance, the springs 44 can be replaced with one or more torsion or leaf springs, or with one or more resiliently deformable grommets or bushings. Likewise, the springs 69 can be replaced similar components, sized for reception within the bores 67.

In a specific embodiment, the electrical connector plunger 50 have a diameter of about 0.750 inches, while the plunger opening 67 within the retainer plate 66 has a diameter of 0.812 inches. This same diameter difference namely 0.062 inches, is carried through between the plunger base 76 and the plunger bore 64. It has been found that these diameter differences allow a sufficient amount of play or angular variation in the position of the plunger 50 relative to the insulted plate 54.

In addition, the specific embodiment the chamfers are formed at an angle of about 45°. The lower chamfer is more important of the two chamfers because it bears against the underside of the retainer plate 66. While the plunger 50 is shown depressed within the bore 64 in FIG. 6, under certain conditions the plunger 50 can be immediately adjacent the retainer plate 66. In order to accommodate a beneficial amount of play or angular variation of the plunger, the chamfer provides clearance from the edge of the plunger base 76 as the plunger tips slightly within the opening 67.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. An electrical connection assembly for an electrical component mounted on a bed movably mounted on a frame of a vehicle having a power source, the assembly comprising:

a first sub-assembly mountable to the frame and including a first number of electrical contacts electrically connectable to the vehicle power source, each of said number of electrical contacts being biased toward the bed of the vehicle when the first sub-assembly is mounted on the frame; and a second sub-assembly including a second number of electrical contacts electrically connectable to the electrical component, said second sub-assembly mountable on the bed of the vehicle so that said second number of electrical contacts move into and out of electrical engagement with said first number of electrical contacts as the bed moves relative to the frame, each of said second number of electrical contacts being biased toward the frame of the vehicle when the second sub-assembly is mounted on the bed.

2. The electrical connection assembly according to claim 1, wherein said first sub-assembly includes:

a first insulator plate mountable to the vehicle frame;

said first number of electrical contacts includes at least one electrically conductive plate supported on said first insulator plate; and first means for biasing said first insulator plate away from the vehicle frame disposed between said first insulator plate and the frame when said first insulator plate is mounted thereto.

3. The electrical connection assembly according to claim 2, wherein said first sub-assembly includes:

at least two bolts for mounting said first insulator plate to the vehicle frame; and said first means for biasing includes a coil spring concentrically disposed about a corresponding one of said bolts.

4. The electrical connection assembly according to claim 3, wherein said first subassembly includes an L-shaped bracket mountable to the vehicle frame, said bracket including a portion configured to engage said at least two bolts with said coil spring disposed between said bracket and said first insulator plate.

5. The electrical connection assembly according to claim 1, wherein said second sub-assembly includes:

a second insulator plate mountable to the bed of the vehicle;

said second number of electrical contacts include a plunger electrically connectable to the electrical component, said plunger movably supported by said second insulator plate; and second means for biasing said plunger away from said plate.

6. The electrical connection assembly according to claim 5, wherein said second insulator plate defines a bore corresponding to said plunger, said plunger being slidably supported within said bore.

7. The electrical connection assembly according to claim 6, wherein said second means for biasing includes a spring disposed within said bore between said plunger and said second insulator plate.

8. The electrical connection assembly according to claim 6, wherein:

said plunger includes an elongated body and an enlarged head disposed within said bore; and said second sub-assembly includes a retainer plate disposed over said bore and defining an opening sized to receive said elongated body but not said enlarged head therethrough.

9. The electrical connection assembly according to claim 8, wherein said enlarged head defines a chamfer adjacent said retainer plate.

10. The electrical connection assembly according to claim 9, wherein said opening is sized relative to said elongated body of said plunger to permit said plunger to assume a non-perpendicular angle relative to said retainer plate with said chamfer in contact with said retainer plate.

11. The electrical connection assembly according to claim 10, wherein second means for biasing includes a spring disposed within said bore between said plunger and said second insulator plate.

12. The electrical connection assembly according to claim 11, wherein said enlarged head of said plunger defines a second chamfer adjacent said spring.

13. The electrical connection assembly according to claim 5, wherein:

said first number of electrical contacts includes at least one electrically conductive plate; and said second number of electrical contacts includes at least one plunger corresponding to said at least one electrically conductive plate.

14. The electrical connection assembly according to claim 1, wherein:

said first number of electrical contacts includes at least one of an electrically conductive plate or an electrically conductive plunger; and said second number of electrical contacts includes a corresponding number of the other of an electrically conductive plate or an electrically conductive plunger.

15. An electrical connection assembly for an electrical component mounted on a bed movably mounted on a frame of a vehicle having a power source, the assembly comprising:

a first sub-assembly mountable to the frame and including a first number of electrical contacts electrically connectable to the vehicle power source; and a second sub-assembly including a second number of electrical contacts electrically connectable to the electrical component, said second sub-assembly mountable on the bed of the vehicle so that said second number of electrical contacts move into and out of electrical engagement with said first number of electrical contacts as the bed moves relative to the frame, each of said second number of electrical contacts being biased toward the frame of the vehicle when the second sub-assembly is mounted on the bed, and each of said second number of contacts being supported to permit variable angular orientations of said second number of contacts relative to the bed.

16. The electrical connection assembly according to claim 15, wherein said second sub-assembly includes:

an insulator plate mountable to the bed of the vehicle;

said second number of electrical contacts include a plunger electrically connectable to the electrical component, said plunger movably supported by said insulator plate to permit variable angular orientations of said plunger relative thereto; and means for biasing said plunger away from said plate.

17. The electrical connection assembly according to claim 16, wherein said insulator plate defines a bore corresponding to said plunger, said plunger being slidably supported within said bore.

18. The electrical connection assembly according to claim 17, wherein:

said plunger includes an elongated body and an enlarged head disposed within said bore; and said second sub-assembly includes a retainer plate disposed over said bore and defining an opening sized to receive said elongated body but not said enlarged head therethrough.

19. The electrical connection assembly according to claim 18, wherein said enlarged head defines a chamfer adjacent said retainer plate.

20. The electrical connection assembly according to claim 19, wherein said opening is sized relative to said elongated body of said plunger to permit said plunger to assume a non-perpendicular angle relative to said retainer plate with said chamfer in contact with said retainer plate.

21. The electrical connection assembly according to claim 20, wherein second means for biasing includes a spring disposed within said bore between said plunger and said insulator plate.

22. The electrical connection assembly according to claim 21, wherein said enlarged head of said plunger defines a second chamfer adjacent said spring.

* * * * *